United States Patent [19]

Rouse et al.

[11] Patent Number: 4,699,108

[45] Date of Patent: Oct. 13, 1987

[54] FUEL INJECTION PUMPING APPARATUS

[75] Inventors: John A. Rouse, London; Dorian F. Mowbray, Burnham, both of England

[73] Assignee: Lucas Industries Public Limited Company, Birmingham, England

[21] Appl. No.: 853,218

[22] Filed: Apr. 17, 1986

[30] Foreign Application Priority Data

May 28, 1985 [GB] United Kingdom ..... 8513282

[51] Int. Cl.[4] ..... F02M 39/00

[52] U.S. Cl. ..... 123/450; 123/387; 123/506; 123/503; 417/462

[58] Field of Search ..... 123/450, 387, 386, 385, 123/506, 503; 417/462

[56] References Cited

U.S. PATENT DOCUMENTS

| | | | |
|---|---|---|---|
| 3,485,225 | 12/1969 | Bailey | 123/387 |
| 4,362,141 | 12/1982 | Mowbray | 123/450 |
| 4,441,479 | 4/1984 | Jarrett | 123/450 |
| 4,457,277 | 7/1984 | Adey | 123/387 |
| 4,512,137 | 2/1986 | Nakatsuka | 123/450 |

*Primary Examiner*—Carl Stuart Miller

*Attorney, Agent, or Firm*—Balogh, Osann, Kramer, Dvorak, Genova & Traub

[57] ABSTRACT

A fuel injection pumping apparatus of the rotary distributor type includes a rotary distributor member which is biased axially in one direction by a spring and is movable in the opposite direction by fluid pressure in a chamber. The axial setting of the distributor member determines the amount of fuel delivered by the apparatus. Fuel is supplied to the chamber through a supply path including a port and a groove which register intermittently as the distributor member rotates. Fuel is allowed to drain from the chamber through a drain path which includes a further port and a tapered groove defined by the distributor member and an axially adjustable sleeve surrounding the distributor member. The further port and the tapered groove register intermittently and it is arranged that the supply path and the drain path are closed to create a hydraulic lock in the chamber during the time mechanical forces are applied to the distributor member.

4 Claims, 2 Drawing Figures

FUEL INJECTION PUMPING APPARATUS

Figure 1:
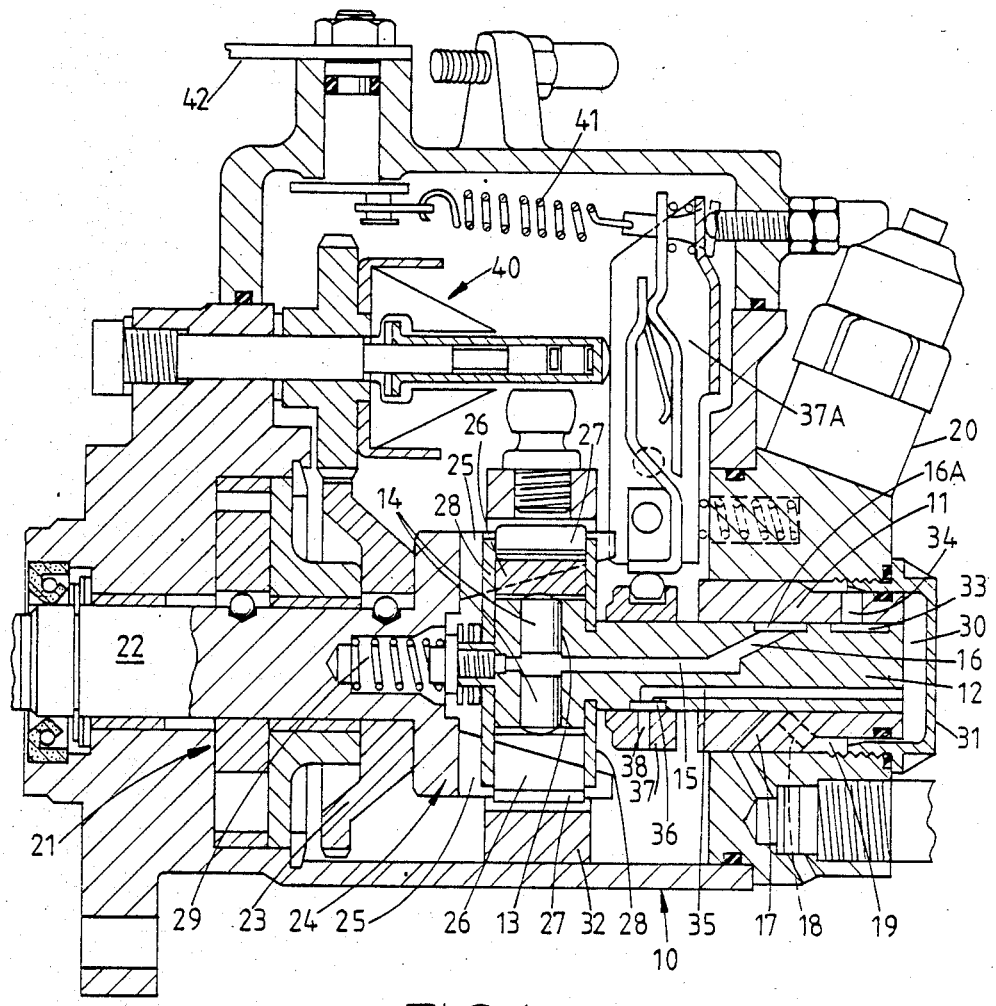

This invention relates to liquid fuel injection pumping apparatus of the kind comprising a rotatable and axially movable fuel distributor member housed within a body, a reciprocable pumping plunger housed within a bore formed in the distributor member, cam means mounted in the body for effecting inward movement of the plunger as the distributor member rotates, passage means in the body and distributor member through which fuel can flow to the bore to effect outward movement of the plunger and through which fuel can flow to an outlet during inward movement of the plunger by the cam means, stop means for limiting the extent of outward movement of the plunger and thereby the quantity of fuel supplied through the outlet, the extent of outward movement depending on the axial setting of the distributor member in the body, resilient means biasing the distributor member in one axial direction, a chamber defined in the body and means for controlling the fluid pressure in said chamber thereby to control the axial setting of the distributor member.

An apparatus of the aforesaid type is shown in British specification No. 2069722. In the example shown in FIG. 1 thereof the distributor member extends into the chamber which is supplied with fuel from the outlet of a low pressure supply pump by way of ports in the body and distributor member, the ports registering with each other intermittently as the distributor member rotates. The ports form a fixed restricted orifice. Fuel escapes from the chamber through a variable orifice which is defined by a drain port opening onto the periphery of the distributor member, the effective area of which can be controlled by a sleeve slidable axially on the distributor member. The drain port and sleeve form a variable orifice but the drain port is at all times partly open. During the operation of the apparatus the stop means can impart axial thrust to the distributor member causing slight axial displacement thereof and as a result the axial position of the distributor member cannot be precisely determined.

The object of the present invention is to provide an apparatus of the kind specified in a simple and convenient form.

According to the invention in an apparatus of the kind specified the means for controlling the fluid pressure in said chamber comprises a supply path to said chamber, a rotary part movable axially with the distributor member, a first axial groove having parallel sides and a port positioned for intermittent registration with the groove as the part rotates, said supply path including said axial groove and said port, the port and groove forming a fixed restriction, an axially movable sleeve surrounding a portion of said rotary part, said sleeve and said rotary part defining a drain path from said chamber which is opened intermittently as the rotary part rotates, said drain path comprising a port and a second groove having axially tapered sides, the second groove and associated port forming a variable restrictor through which fluid can flow to decrease the pressure in the chamber, the relative axial positions of the rotary part and sleeve determining the degree of restriction offered by the variable restrictor, said supply path and drain path being arranged to be closed when the outward movement of the plunger is halted by said stop means.

Figure 2:
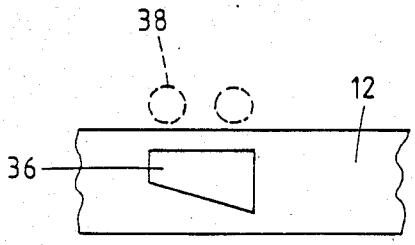

An example of an apparatus in accordance with the invention will now be described with reference to the accompanying drawings in which:

FIG. 1 is a sectional side elevation of one example of an apparatus incorporating the invention, and FIG. 2 is a view of part of the apparatus seen in FIG. 1 with a further part of the apparatus of FIG. 1 removed.

Referring to the drawings, the apparatus comprises a multi-part body 10 which includes a sleeve 11 in which is mounted a rotary cylindrical distributor member 12. The distributor member 12 projects from the sleeve 11 and is provided with an outwardly extending through bore 13 in which is mounted a pair of plungers 14. The bore 13 communicates with an axial passage 15 formed in the distributor member which connects with a delivery passage 16 terminating on the periphery of the distributor member in an axial groove 16A. This groove registers in turn and as the distributor member rotates, with outlet ports 17 which in use are connected to the injection nozzles respectively of the associated engine. The groove 16A also registers with inlet passages 18 the inner ends of which and the ports 17 lie in the same radial plane. The inlet passages communicate with a circumferential groove 19 which is formed in the peripheral surface of the sleeve and this communicates by way of an on/off valve 20, with the outlet of a fuel supply pump which is generally indicated at 21. The pump 21 draws fuel from a fuel inlet not shown and its output pressure is controlled by a valve also not shown.

The rotary part of the pump 21 is carried on a drive shaft 22 which is journalled in the body and which in use, is driven from the associated engine. The shaft carries a dished gear wheel 23 and has an enlarged head portion 24 which surrounds the end of the distributor member 12. The head portion defines a pair of slots 25 in which are located shoes 26, the shoes at their inner ends engaging with the plungers 14 respectively and at their outer ends defining grooves in which are located rollers 27.

In addition, located in the slots 25 are drive plates 28 which are connected to the distributor member. The drive plates transmit drive between the shaft 22 and the distributor member but at the same time allow axial movement of the distributor member within the sleeve.

The internal surface of the enlarged portion 24 of the shaft is flared outwardly and the shoes 26 are provided with complementary surfaces. The flared surface of the enlarged portion and the complementary surfaces on the shoes define stop means to limit the extent of outward movement of the plungers 14 and the extent of such outward movement can be varied by altering the axial position of the distributor member.

The shaft 22 also defines a chamber in which is located a coiled compression spring 29, the compression spring acting between the drive shaft and the distributor member to urge the distributor member towards the right as shown in the drawing. A chamber 30 is defined in part by the end surface of the distributor member and in part by a cover 31, the cover having a skirt portion which locates over the reduced end portion of the sleeve 11. A fluid seal is defined between the cover 31 and the reduced end portion of the sleeve by means of a sealing ring whereby fuel under pressure in the groove 19 cannot enter directly the chamber 30.

The rollers 27 engage the internal peripheral surface of an angularly adjustable cam ring 32 and on the internal peripheral surface of the cam ring are formed pairs of cam lobes. The lobes are positioned such that inward movement of the plungers 14 can only takes place while the groove 16A at the end of the passage 16, is in communication with an outlet 17. When the groove 16A moves into register with an inlet passage 18, fuel is supplied to the bore 13 and the plungers 14 are moved outwardly. The extent of outward movement of the plungers is limited by the abutment of the surfaces on the shoes with the flared surface of the enlarged portion of the drive shaft. The axial setting of the drive shaft therefore determines the extent of outward movement of the plungers. When the shoes engage with the flared surface, there will due to the inclination of the surfaces, be an axial thrust imparted to the distributor member which tends to move the distributor member towards the right as seen in the drawing.

In order to control the axial setting of the distributor member, there is formed in the distributor member a first series of grooves 33 only one of which is shown, which communicate in turn as the distributor member rotates, with a port 34 communicating with the chamber 19. When communication is established between a groove 33 and the port 34 fuel under pressure can flow into the chamber 30. Because of the intermittent nature of the connection between the grooves 33 which have parallel sides, and the port 34, the port and grooves form a fixed restrictor.

Fuel can escape from the chamber 30 by way of a drain path which includes a passage 35 formed in the distributor member and connecting the chamber 30 with a series of grooves 36 only one of which is shown, on the periphery of the portion of the distributor member extending from the sleeve 11.

Surrounding the projecting portion of the distributor member is a non-rotatable but axially movable sleeve 37 in which is formed a radial port 38.

As seen in FIG. 2 the slots 36 have tapering sides and the slots together with the port 38 constitute a variable restrictor. As the sleeve 37 is moved towards the right the degree of restriction is reduced and vice versa.

The axial position of the sleeve 37 is determined by a governor mechanism which in the particular example, comprises a centrifugal weight mechanism 40 which is coupled to the sleeve 37 by a pivotal lever 37A and which as the speed of rotation of the distributor member and drive shaft increases, moves to displace the sleeve towards the left. This movement takes place against the action of a governor spring 41, the force exerted by the spring being adjustable by means of an operator adjustable member 42.

In operation, the grooves 36 and port 38 constitute a variable restrictor through which fuel can drain from the chamber and the grooves 33 and the port 34 constitute a fixed restrictor through which fuel is supplied to the chamber 30. If it is required to increase the pressure in the chamber the sleeve 37 is moved towards the left as shown in the drawings and the effect of this is that the degree of restriction in the drain path is increased. As a result the pressure in the chamber 30 increases and an increased force acts on the end of the distributor member to move the distributor member towards the left. Movement of the distributor member towards the left reduces the degree of restriction in the drain path and an equilibrium position is established in which the distributor member occupies a position which is to the left of the position which it occupied when the sleeve was first moved to the left. Movement of the sleeve towards the left as seen in the drawing will be effected by the weight mechanism which is sensitive to the speed of the drive shaft and hence the associated engine. A governing action is therefore obtained. If the force exerted by the spring 41 is increased by the action of the operator or if the engine speed falls, the sleeve 37 moves towards the right and the degree of restriction offered by the drain path is reduced thereby causing a reduction in the pressure in the chamber 30 and movement of the distributor member towards the right until a new equilibrium position is established. Communication of the grooves 33 with the port 34 and the grooves 36 with the port 38 is arranged to take place before the surfaces on the shoes co-operate with the tapered surface on the enlarged part of the distributor member so that a hydraulic lock exists in the chamber 30 when said surfaces engage with each other. In this manner movement of the distributor member by the axial thrust developed when the surfaces engage with each other, is prevented.

The aforesaid British Specification No. 2069722 illustrates in FIG. 4 thereof a construction in which a separate rotary member axially movable with the distributor member, is used to develop the force applied, to the distributor member to move the latter against the action of its spring. Such a rotary member can be incorporated into the design of the apparatus shown in FIG. 1, the rotary member being provided with the grooves 33 and 36 and a separate sleeve surrounding the rotary member would incorporate the port 38.

We claim:

1. A liquid fuel injection pumping apparatus comprising a rotary and axially movable fuel distributor member housed within a body, a reciprocable pumping plunger housed within a bore formed in the distributor member, cam means mounted in the body for effecting inward movement of the plunger as the distributor member rotates, passage means in the body and distributor member through which fuel can flow to the bore to effect outward movement of the plunger and through which fuel can flow to an outlet during inward movement of the plunger by the cam means, stop means for limiting the extent of outward movement of the plunger and thereby the quantity of fuel supplied through the outlet, the extent of outward movement depending on the axial setting of the distributor member in the body, resilient means biasing the distributor member in one axial direction, a chamber defined in the body, means for controlling the fluid pressure in said chamber to control the axial setting of the distributor member, said means comprising a supply path to said chamber, a rotary part movable axially with the distributor member, a first axial groove having parallel sides and a port positioned for intermittent registration with the groove as the part rotates, said supply path including said axial groove and said port, the port and groove forming a fixed restriction, an axially movable sleeve surrounding a portion of said rotary part, said sleeve and said rotary part defining a drain path from said chamber which is opened intermittently as the rotary part rotates, said drain path comprising a port and a second groove having axially tapered sides, the second groove and associated port forming a variable restrictor through which fluid can flow to decrease the pressure in the chamber, the relative axial positions of the rotary part and sleeve determining the degree of restriction offered by the variable restrictor, said supply path and drain path being arranged to be closed when the outward movement of the plunger is halted by said stop means.

2. An apparatus according to claim 1 in which said rotary part is defined by the distributor member.

3. An apparatus according to claim 1 including a governor mechanism for controlling the position of said sleeve.

4. An apparatus according to claim 2, including a governor mechanism for controlling the position of said sleeve.

* * * * *